US007137915B2

(12) United States Patent
Lin

(10) Patent No.: US 7,137,915 B2
(45) Date of Patent: Nov. 21, 2006

(54) BALL WITH A FOAM COVERED CARCASS AND A METHOD FOR MAKING A BALL WITH A FOAM COVERED CARCASS

(75) Inventor: Chun-Nan Lin, Taipei (TW)

(73) Assignee: Yuan Chi Sports Enterprise Co., Ltd (TW)

( * ) Notice: Subject to any disclaimer, the term of this patent is extended or adjusted under 35 U.S.C. 154(b) by 114 days.

(21) Appl. No.: 11/089,002

(22) Filed: Mar. 24, 2005

(65) Prior Publication Data

US 2006/0217219 A1 Sep. 28, 2006

(51) Int. Cl.
*A63B 41/00* (2006.01)

(52) U.S. Cl. ..... 473/605

(58) Field of Classification Search ..... 473/603–605, 473/593, 594, 596, 599, 607, 610
See application file for complete search history.

(56) References Cited

U.S. PATENT DOCUMENTS 5,310,178 A * 5/1994 Walker et al. ..... 473/605
5,470,058 A * 11/1995 Sullivan et al. ..... 473/603
6,022,283 A * 2/2000 Schindler et al. ..... 473/605
6,206,795 B1 * 3/2001 Ou ..... 473/599
6,422,961 B1 * 7/2002 Feeney ..... 473/604
6,544,133 B1 * 4/2003 Ou ..... 473/604
6,726,582 B1 * 4/2004 Kuo et al. ..... 473/604

* cited by examiner

*Primary Examiner*—Steven Wong
(74) *Attorney, Agent, or Firm*—Hershkovitz & Associates; Abe Hershkovitz

(57) ABSTRACT

A ball with a foam carcass has an inner bladder, a winding layer, a foam carcass layer, a colored rubber ink layer, and a leather layer. The inner bladder is hollow. The winding layer is attached to and covers the inner bladder. The colored rubber ink is brushed on and covers the foam carcass layer. The foam carcass layer with the colored rubber ink layer with the colored rubber ink is attached to and covers the winding layer to form a foam covered carcass. The foam covered carcass is vulcanized. The colored rubber ink layer covers the uneven foam-carcass layer to form an even foam covered carcass. The leather layer is attached to the foam covered carcass.

4 Claims, 5 Drawing Sheets

BALL WITH A FOAM COVERED CARCASS AND A METHOD FOR MAKING A BALL WITH A FOAM COVERED CARCASS

BACKGROUND OF THE INVENTION

1. Field of the Invention

The present invention relates to a method for making a ball, especially to a method for making a ball with a foam covered carcass.

2. Description of the Prior Art

With reference to FIGS. 4 and 5, a conventional method for making a leather laminated ball (for example: a basketball, volleyball, etc.) comprises winding a winding layer (70) on an inner bladder (60), attaching a foam rubber carcass (80) to the winding layer (70), vulcanizing a foam covered carcass and attaching a leather layer (90) to the foam covered carcass to form the ball.

The winding layer (70) is wound on and covers the inner bladder (60). The foam rubber carcass (80) is attached to and covers the winding layer (70) to form the foam covered carcass. Then the foam covered carcass is vulcanized. After vulcanizing, the leather layer (90) is laminated on and covers the foam carcass to form the ball.

However, the foam covered carcass easily forms unevenly and has a high defective ratio because of the vulcanizing speed, foaming speed and inadequate mold air exhaust during vulcanization.

To overcome the shortcomings, the present invention provides an improved method for making a ball with a foam covered carcass to mitigate or obviate the aforementioned problems.

SUMMARY OF THE INVENTION

The main objective of the present invention is to provide a ball with a foam covered carcass that has an even surface. The ball with a foam covered carcass has an inner bladder, a winding layer, a foam carcass layer, a colored rubber ink layer and a leather layer. The inner bladder is hollow. The winding layer is wound on and covers the inner bladder. The colored rubber ink is brushed on and covers the foam carcass layer. The foam carcass layer with the colored rubber ink is attached to and covers the winding layer to form a foam covered carcass. The foam covered carcass is vulcanized. The colored rubber ink layer covers the uneven foam carcass layer to form an even foam covered carcass surface. The leather layer is attached to the foam covered carcass.

Other objectives, advantages and novel features of the invention will become more apparent in the following detailed description when taken in conjunction with the accompanying drawings.

DETAILED DESCRIPTION OF THE PREFERRED EMBODIMENTS

Figure 1:
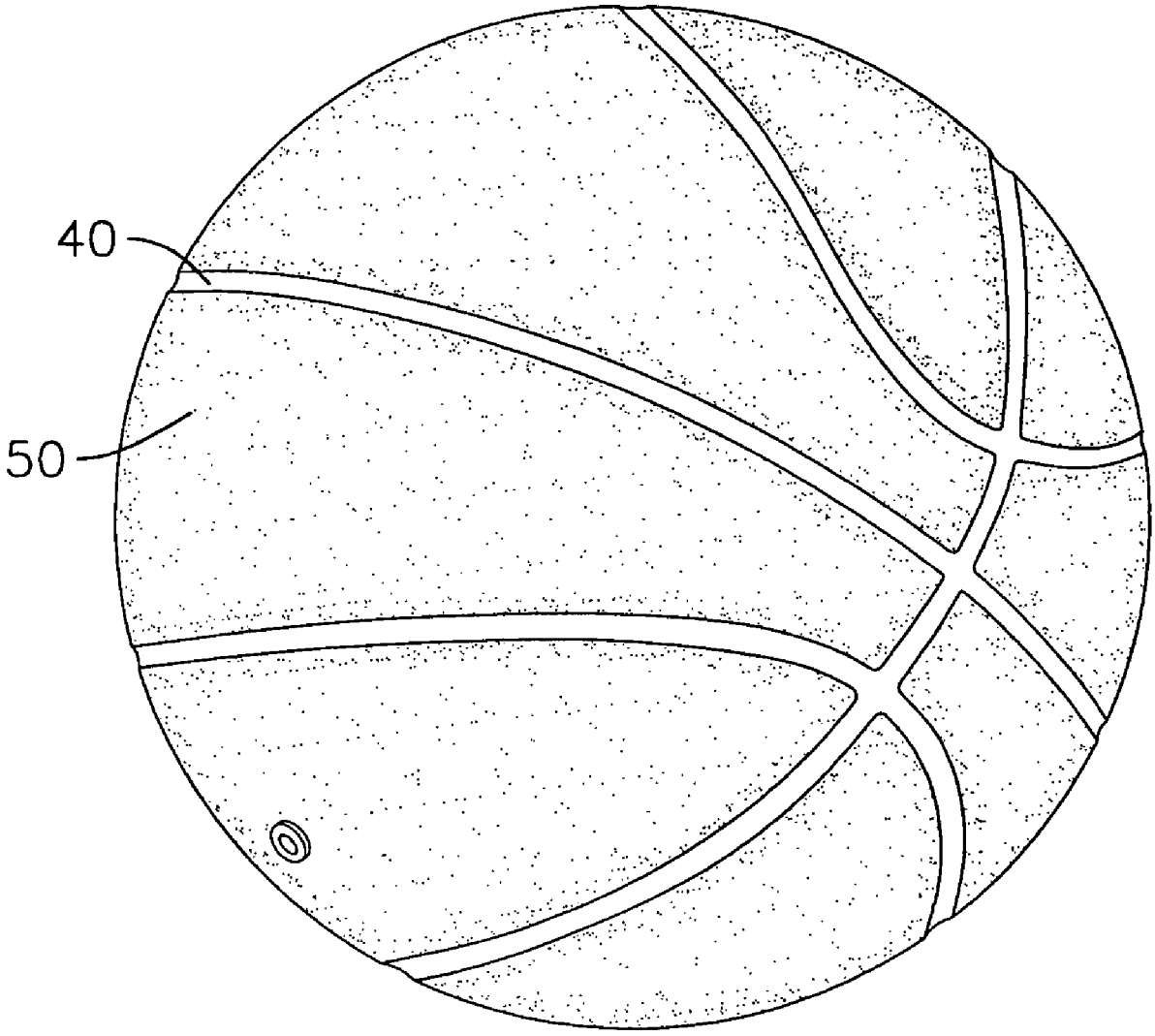
FIG. 1 is a perspective view of a ball with a foam covered carcass in accordance with the present invention.
Figure 2:
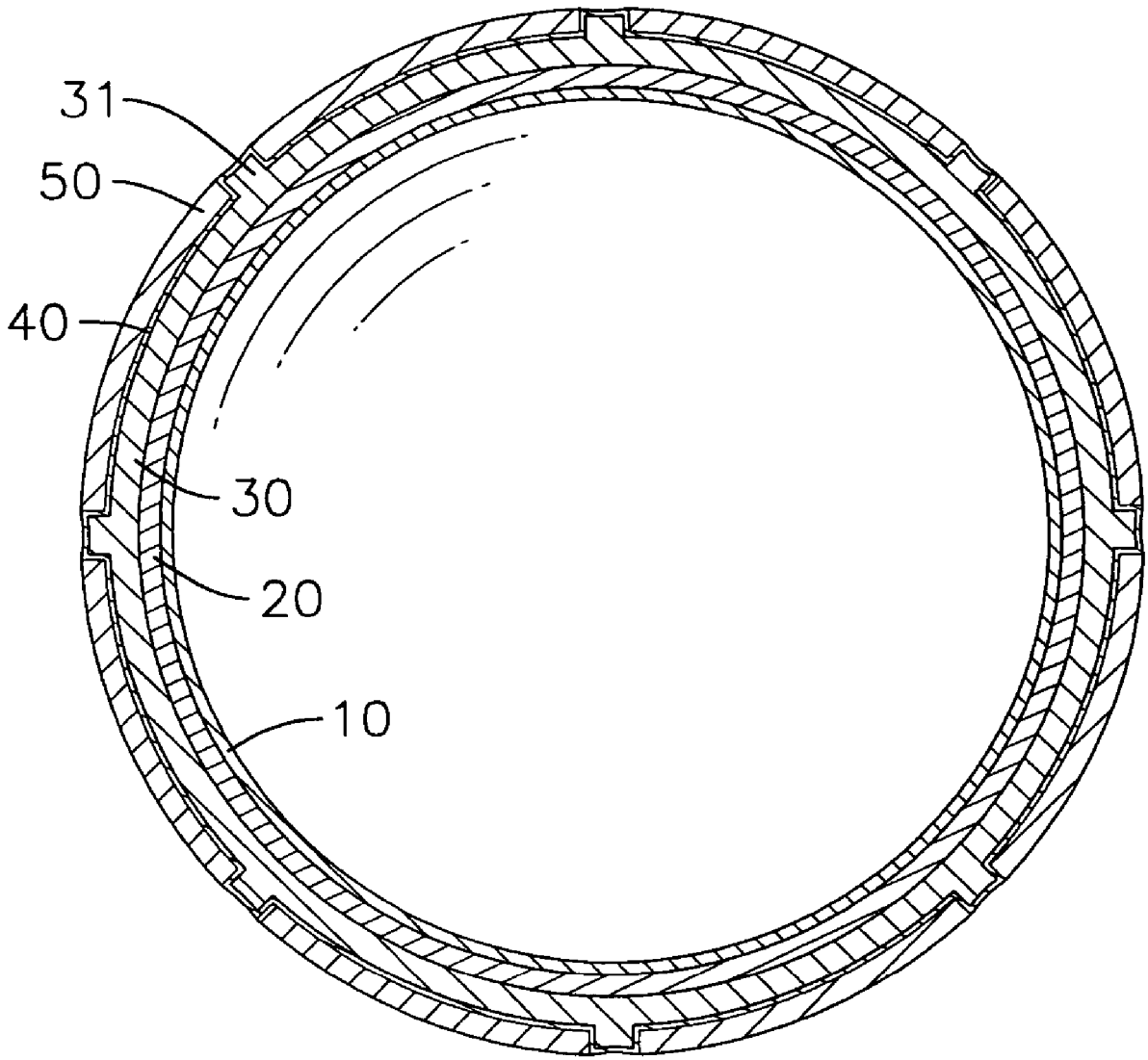
FIG. 2 is a cross sectional side view of the ball in FIG. 1.

With reference to FIGS. 1 and 2, a ball with a foam covered carcass in accordance with the present invention comprises an inner bladder (10), a winding layer (20), a foam carcass layer (30), a colored rubber ink layer (40) and a leather layer (50).

Figure 3:
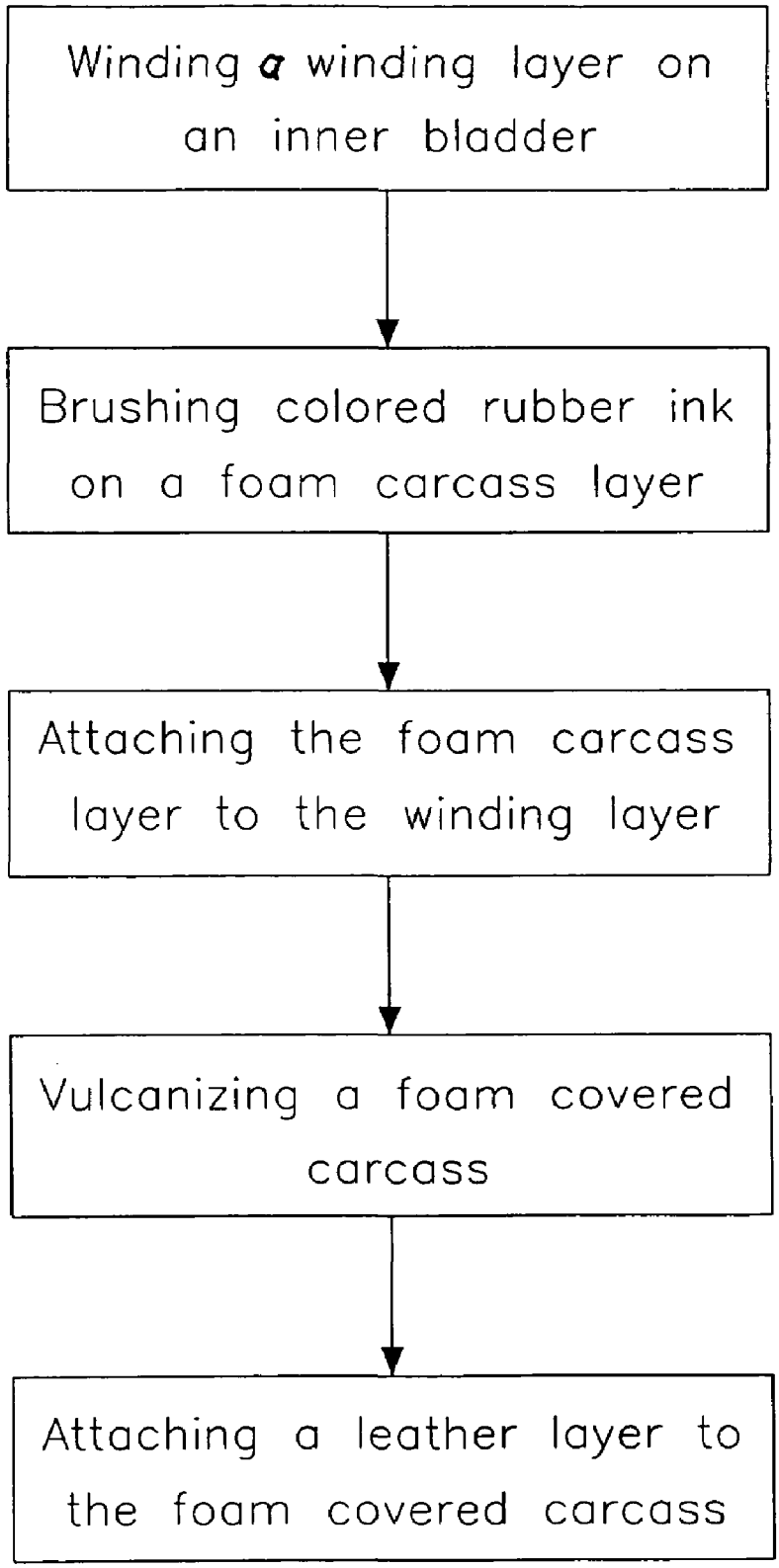
FIG. 3 is a block diagram of a method for making a ball with a foam covered carcass in accordance with the present invention.
Figure 4:
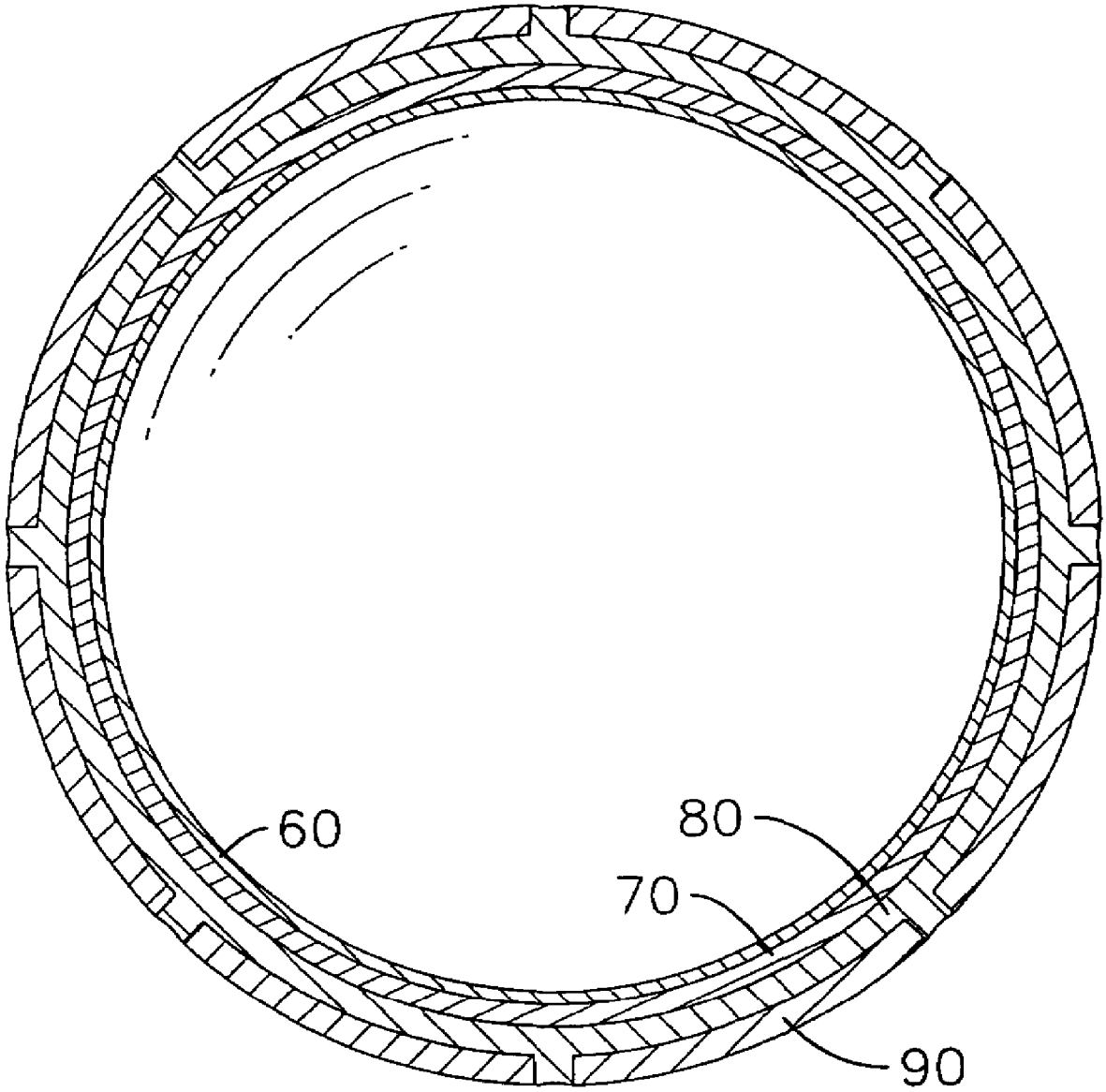
FIG.4 PRIOR ART
FIG. 4 is a cross sectional side view of a conventional ball with a foam covered carcass in accordance with the prior art.
Figure 5:
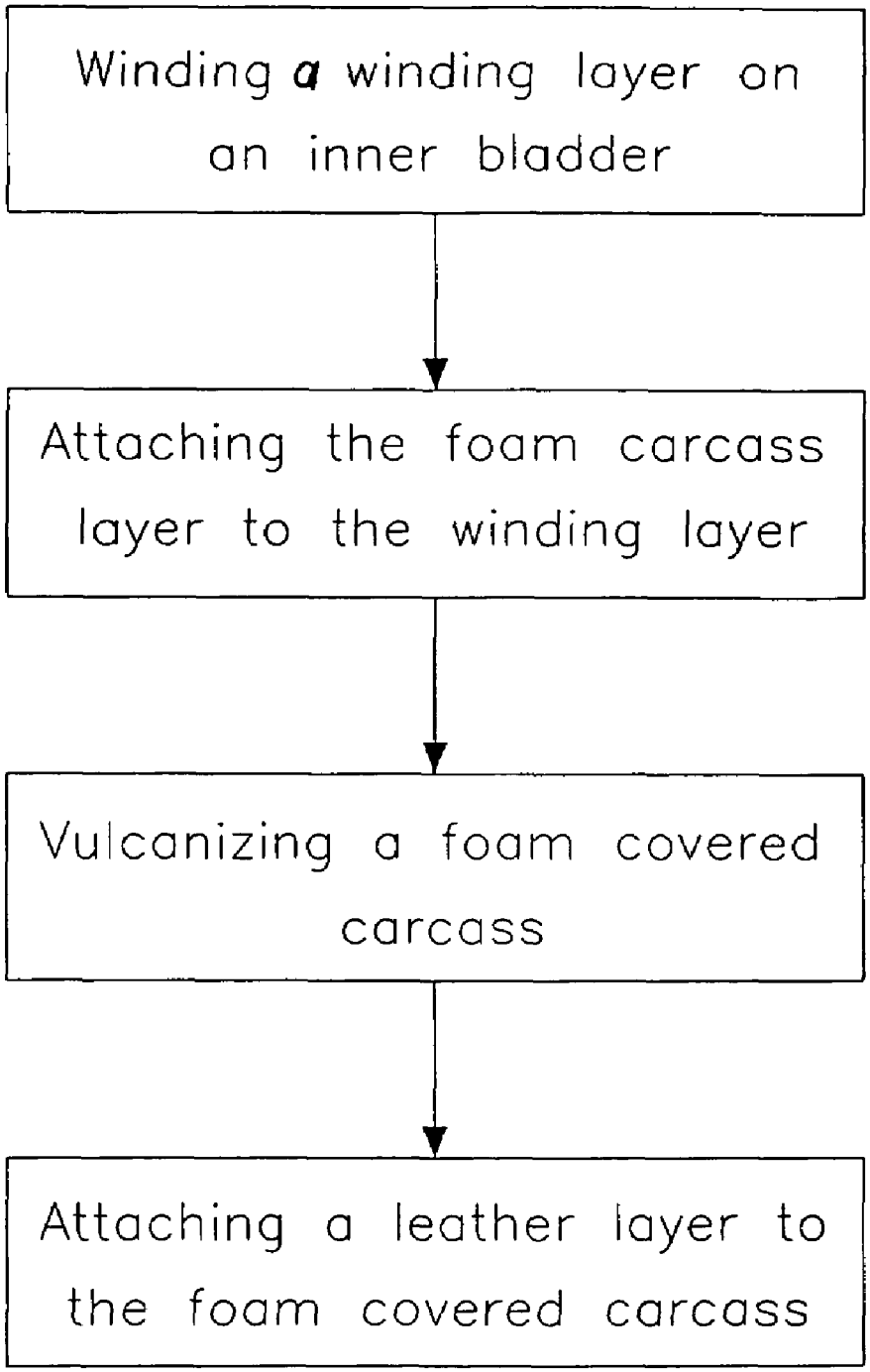
FIG.5 PRIOR ART
FIG. 5 is a block diagram of a method for making a conventional ball with a foam covered carcass in accordance with the prior art.

With further reference to FIG. 3, a method for making a ball with a foam carcass in accordance with the present invention comprises winding the winding layer (20) on the inner bladder (10), brushing colored rubber ink on the foam carcass layer (30) to form the colored rubber ink layer (40), attaching the foam carcass layer (30) with the colored rubber ink layer (40) to the winding layer (20) to form a foam covered carcass, vulcanizing the foam covered carcass and attaching the leather layer (50) to the foam covered carcass.

The inner bladder (10) is hollow.

The winding layer (20) is wound on and covers the inner bladder (10).

The foam carcass layer (30) is attached to and covers the winding layer (20) and has multiple elevated protrusions (31). The multiple elevated protrusions (31) are formed on and extend out from the foam carcass layer (30).

The colored rubber ink layer (40) may be 70 PHR thermoplastic elastomer (TPE), 30 PHR styrene-butadiene rubber (SBR), 10 PHR poly-ethene glycol (PEG), 10 PHR zinc-oxide (ZnO), 3 PHR tetramethyl thiuram disulfide (TT), 50 PHR calcium-carbonate ($CaCO_3$), 10 PHR black color master batch and solvent and is brushed on and covers the foam carcass layer (30). In a rubber mixture, PHR means that if a content of a rubber is 20 and a content of A is 15, the rubber mixture has 75 PHR A. The solvent may be made by 60% ethyl-acetate, 20% butyl-acetate and 20% turpentine oil.

The foam carcass layer (30).with the colored rubber ink layer (40) is attached to the winding layer (20) to form the foam covered carcass.

The foam covered carcass is vulcanized. After vulcanizing, the colored rubber ink layer (40) becomes even and dense. Although the foam carcass layer (30) is uneven after vulcanizing, the even and dense colored rubber ink layer (40) covers the foam carcass layer (30) to form an even foam covered carcass.

The leather layer (50) is attached to the foam covered carcass between the multiple elevated protrusions (31).

The ball with new foam covered carcass has numerous advantages. The even colored rubber ink layer (40) covers the uneven foam carcass layer (30) after vulcanizing to form the even foam covered carcass. Changing the colored rubber ink layer (40) to form a different colored foam covered carcass.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ball with a foam covered carcass comprising an inner bladder being hollow;

a winding layer covering the inner bladder;

a foam carcass layer covering the winding layer and having multiple elevated protrusions formed on and extending out from the foam carcass layer;

a colored rubber ink layer covering the foam carcass layer; and a leather layer attached between the elevated protrusions to the colored rubber ink layer on the foam covered carcass.

2. The ball as claimed in claim 1, wherein the colored rubber ink layer is 70 PHR thermoplastic elastomer (TPE), 30 PHR styrene-butadiene rubber (SBR), 10 PHR polyethene glycol (PEG), 10 PHR zinc-oxide (ZnO), 3 PHR tetramethyl thiuram disulfide (TT), 50 PHR calcium-carbonate ($CaCO_3$), 10 PHR black color master batch and solvent.

3. The ball as claimed in claim 2, wherein the solvent is 60% ethyl-acetate, 20% butyl-acetate and 20% turpentine oil.

4. A method for making the ball in claim 1 comprising acts of: winding a winding layer on an inner bladder; brushing colored rubber ink on a foam carcass layer; attaching the foam carcass layer to the winding layer to form a foam covered carcass; vulcanizing the foam covered carcass; and attaching a leather layer to the foam covered carcass.

* * * * *